United States Patent [19]

Meyer et al.

[11] 4,055,396

[45] Oct. 25, 1977

[54] TRAY AND CARRIER ASSEMBLY

[75] Inventors: Rolf Meyer, Des Plaines; Manuel I. Martin, Hoffman Estates, both of Ill.

[73] Assignee: G. D. Searle & Co., Skokie, Ill.

[21] Appl. No.: 669,138

[22] Filed: Mar. 22, 1976

Related U.S. Application Data

[63] Continuation-in-part of Ser. No. 594,939, July 11, 1975, abandoned.

[51] Int. Cl.[2] ..... B01L 9/06

[52] U.S. Cl. ..... 23/259; 248/311.1

[58] Field of Search ..... 23/292, 253 R, 259; 211/74, 71; 248/27 A, 27 R, 314, 311, 146; 141/369, 372; 233/26

[56] References Cited

U.S. PATENT DOCUMENTS

| | | | |
|---|---|---|---|
| 3,709,429 | 1/1973 | McKenzie et al. | 211/74 X |
| 3,905,772 | 9/1975 | Hartnett et al. | 23/259 |

FOREIGN PATENT DOCUMENTS

| | | | |
|---|---|---|---|
| 833,867 | 3/1952 | Germany | 211/74 |
| 1,095,429 | 12/1967 | United Kingdom | 211/74 |

*Primary Examiner*—Morris O. Wolk
*Assistant Examiner*—Roger F. Phillips
*Attorney, Agent, or Firm*—Walter C. Ramm; Albert Tockman; Dennis O. Kraft

[57] ABSTRACT

A tray and carrier assembly which is adapted to simultaneously handle a plurality of open ended receptacles such as test tubes or the like. The tray includes a member having the underside thereof removably engaged by a support. Subtending the support in spaced relation and connected thereto is a base member. The tray member is provided with a plurality of openings in which are loosely disposed retainer elements which frictionally engage the open ends of the receptacles whereby the remainder of the receptacles depend freely from the tray member when the latter is assembled on the support. The tray member and the support are provided with complementary interfitting means which coact so as to require the tray member to assume a predetermined relative position when assembled on the support.

8 Claims, 8 Drawing Figures

TRAY AND CARRIER ASSEMBLY

BACKGROUND OF THE INVENTION

This application is a continuation in part of application Ser. No. 594,939, filed July 11, 1975, and now abandoned.

Heretofore the handling of a plurality of open end receptacles, such as test tubes, in which specimens and samples have been collected for subsequent analysis, has normally required a substantial amount of time and manual effort. In addition such a procedure required the exercise of extreme care on the part of the person handling the receptacles so as to maintain segregation of the receptacles and/or prevent contamination of the collected specimens or samples. Because of problems such as these, apparatus such as disclosed in copending U.S. application Ser. No. 567,349, filed Apr. 11, 1975, and now U.S. Pat. No. 4,000,976, and assigned to the same assignee as the instant application, have been utilized to accurately and quickly prepare the necessary samples of a specimen so that numerous subsequent tests can be accurately performed thereon.

Various tray and carrier assemblies have heretofore been provided for simultaneously handling such receptacles; however, because of certain design characteristics, such assemblies have been beset with one or more of the following shortcomings: (a) the assembly was heavy, bulky and awkward to handle; (b) the accommodated receptacles were susceptible to breakage or damage; (c) the assembly was incapable of accommodating a variety of receptacles; (d) the receptacles, when accommodated within the assembly, were not readily capable of being actuated independently of one another so as to produce vortical motion to the samples within the receptacles; (e) the accommodated receptacles were not readily accessible for automated independent manipulations when the assembly was accommodated within the apparatus of the type disclosed in the aforenoted pending application; and (f) the assembly was of costly as well as fragile construction. The tray assembly of co-pending U.S. application Ser. No. 596,760, filed July 17, 1975 and assigned to the same assignee as the instant application has done much to solve the foregoing problems, but a carrier for such trays promoting the above advantages, and an interrelationship between tray and carrier or assembly thereof capable of accommodating trays of different capacity, has yet to be provided.

SUMMARY OF THE INVENTION

Thus, it is an object of the invention to provide an assembly which avoids the aforenoted shortcomings besetting prior structures.

It is a further object of the invention to provide an assembly which along with similar assemblies may be readily conveyed by mechanical means to various predetermined stations within an apparatus wherein the receptacles accommodated by the assembly are subjected to prescribed manipulations.

It is a further object of the invention to provide an assembly provided with indexing means whereby the assembly may be automatically indexed to assume predetermined stations.

It is a still further object of the invention to provide an assembly having a support which is capable of accommodating a variety of trays.

Further and additional objects will appear from the description, accompanying drawings and appended claims.

In accordance with one embodiment of the invention, a tray and carrier assembly is provided for use in simultaneously handling a plurality of open end receptacles. The tray of the assembly is provided with a plurality of openings in which are loosely disposed retainer elements. Each element is adapted to frictionally engage the open end of a receptacle whereby the remaining portion of the receptacle is adapted to depend freely from the tray. Marginal portions of the tray are subtended and engaged by a support forming a component of the carrier. The support is positioned in spaced relation above a base member. The space between the support and the base member is adapted to accommodate the freely depending portions of the receptacles when the tray is positioned on the support. The support and tray are provided with complementary interfitting means whereby the tray can only assume a predetermined assembled position on the support.

DESCRIPTION

For a more complete understanding of the invention, reference should be made to the drawings wherein.

Figure 1:
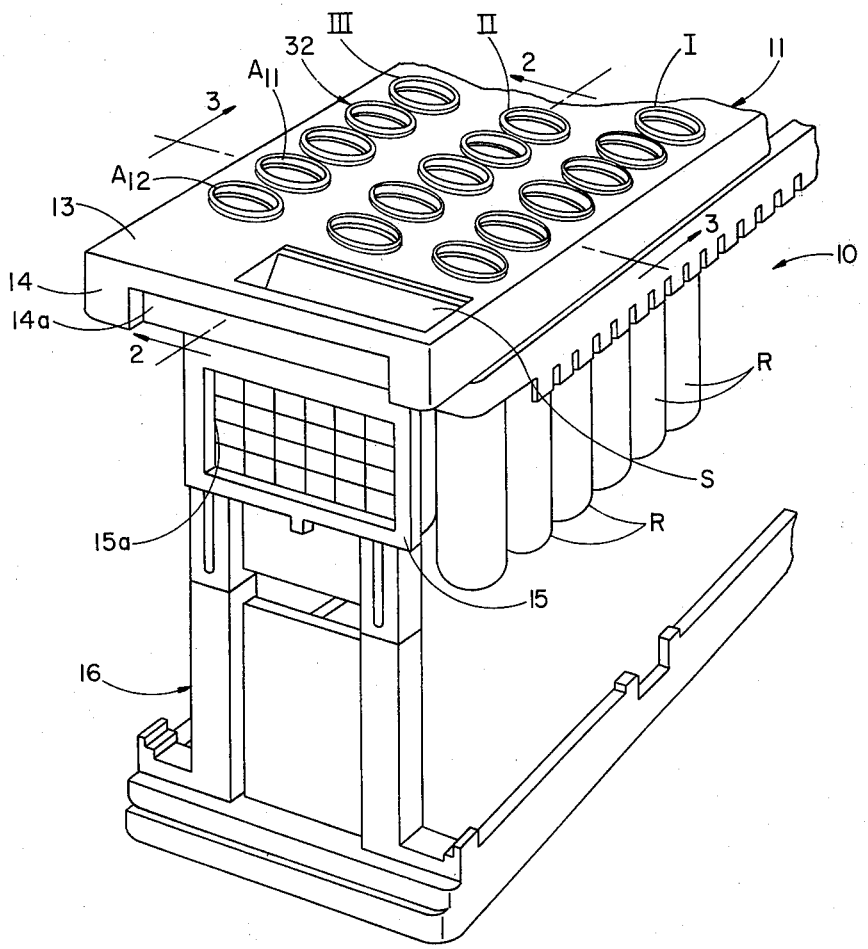
FIG. 1 is a fragmentary top perspective view taken from one end of one form of the imroved tray and carrier assembly.
Figure 4:
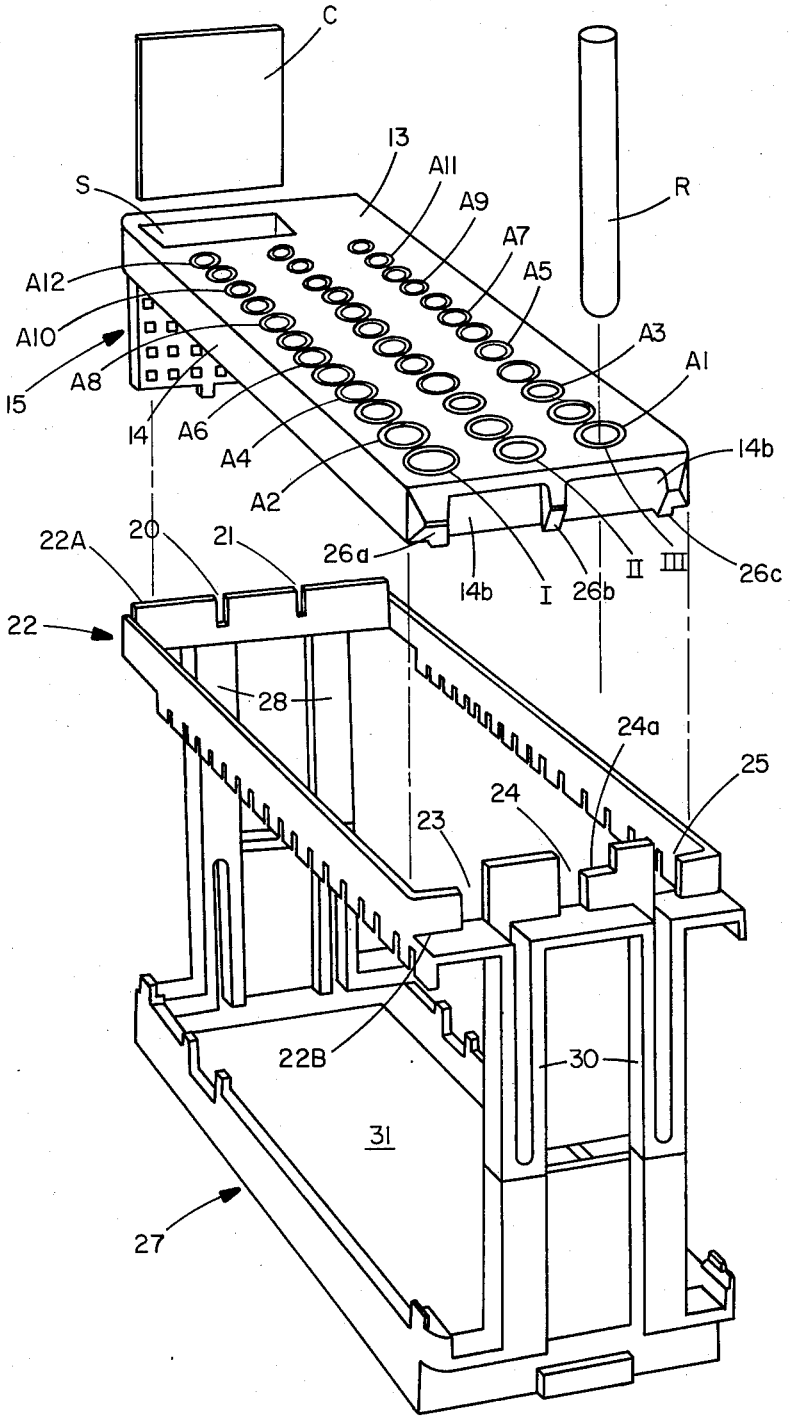
FIG. 4 is a top perspective view taken from the opposite end of the assembly and showing the tray and carrier in disassembled relation.

Referring now to the drawings and more particularly to FIGS. 1 and 4, one form of the improved tray and carrier assembly 10 is shown which is adapted to accommodate a plurality of open end receptacles R, e.g., conventional test tubes. The number of receptacles R accommodated by the assembly will depend upon the size and shape of the tray member 11 utilized. The construction of the tray member of the assembly is substantially as set forth in the above-mentioned co-pending Application Ser. No. 596,760. As illustrated in FIG. 4, tray member 11 is provided with 36 holes or openings 12 which are arranged in twelve transversely extending rows $A_1 - A_{12}$ of three openings each. The rows are in spaced parallel relation and the corresponding openings in each row are in aligned relation so as to form three longitudinally extending rows I, II and III disposed in spaced parallel relation.

Tray member 11 is preferably of a rectangular configuration and has a substantially planar top surface 13. Substantially delimiting top surface 13 and depending therefrom is a marginal flange 14. At opposite ends of the tray member 11, the flange 14 may be provided with recesses **14*a* and 14*b*** which are adapted among other things to accommodate finger tips, not shown, so as to facilitate manual carrying of the tray member.

It will be noted in FIGS. 1 and 4 that at one end of the top surface 13 there is provided an elongated slot S through which a program card C is inserted. The slot S communicates with a card holder 15 which depends from the end of the tray member, see FIG. 1. The holder 15 is preferably a frame-like member having an enlarged opening 15*a* thereby enabling the card indicia to be readily observed or scanned by suitable photosensitive means, not shown. When the tray member 11 is in position on the carrier 16, see FIG. 1, the card holder 15 will be offset outwardly from the carrier.

Figure 2:
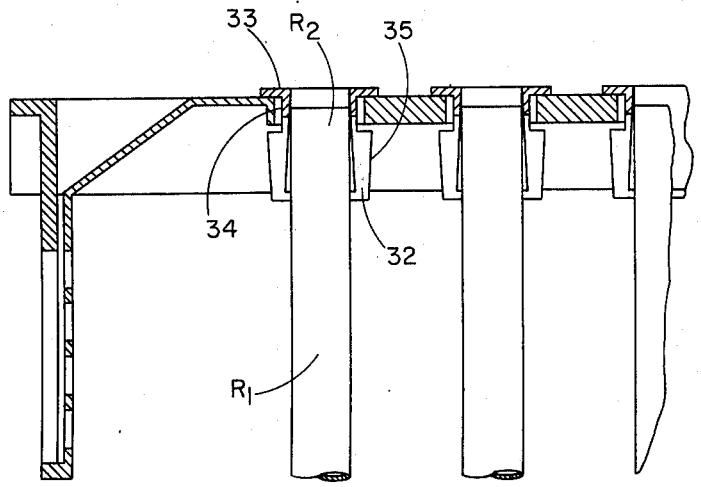
FIG. 2 is an enlarged fragmentary sectional view taken along line 2—2 of FIG. 1.
Figure 3:
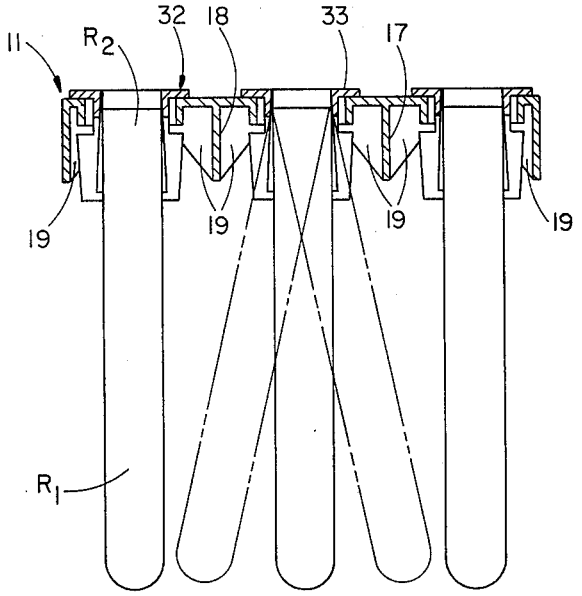
FIG. 3 is an enlarged sectional view taken along line 3—3 of FIG. 1.
Figure 8:
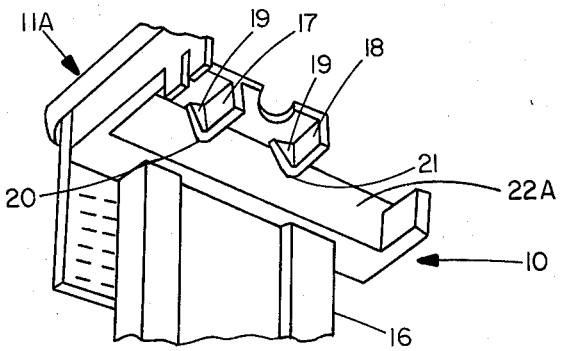
FIG. 8 is a fragmentary bottom perspective view showing the manner of interfitting between carrier and tray at the end opposite that shown in FIGS. 6 and 7.

Disposed between the longitudinal rows I, II and III and depending from the underside of surface 13 are elongated reinforcing ribs 17 and 18 which extend substantially the full length of the tray member 11, see FIGS. 2 and 3. Besides providing reinforcement for the tray member 11, the ribs 17 and 18 are adapted to interfit in suitable narrow slots 20 and 21, respectively formed in one transverse end 22A of the support 22, the latter comprising a component of the carrier 16; see especially FIG. 8. Tray member 11 also includes transverse reinforcing portions 19 extending transversely from ribs 17 and 18 and marginal flange 14 to the lower face of surface 13. While ribs 17 and 18 when within slots 20 and 21 help to hold the tray upon the carrier and against transverse motion relative to the carrier, some of the transverse portions 19 overlaps and engages the inside face of the same end portion 22A of support 22 which carries slots 20 and 21, (see FIG. 8), thus helping to hold the tray against longitudinal shifting relative to the carrier.

The opposite end 22B of support 22 is provided with a plurality of wider vertically extending and upwardly opening slots 23, 24 and 25. The latter slots are adapted to accommodate suitable protuberances 26*a, b* and *c* which are formed on the end of the tray member flange 14 by reason of recesses 14*b,* see FIG. 4.

Figure 6:
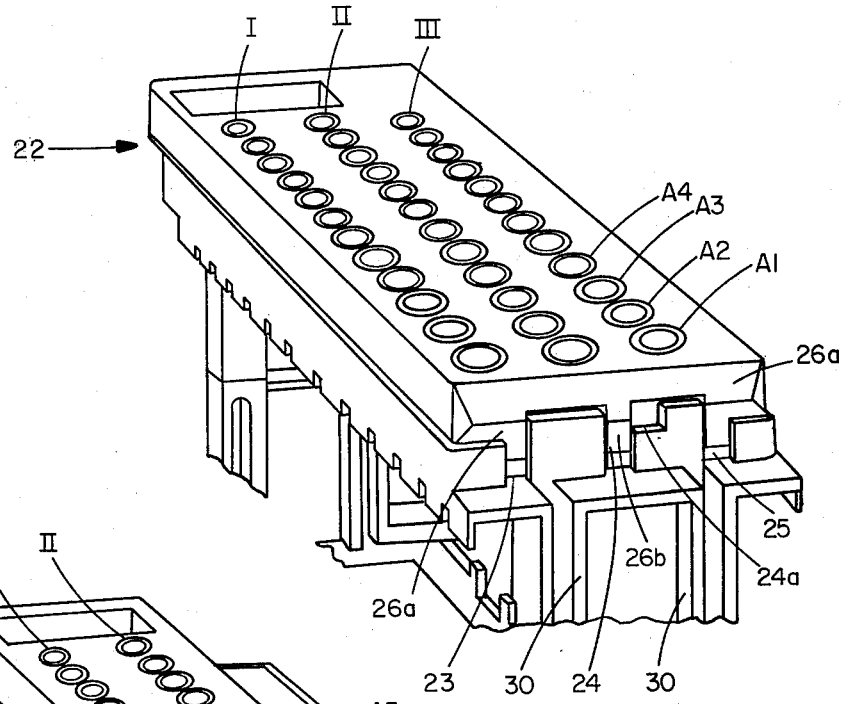
FIG. 6 is a top perspective view similar to FIG. 4, but showing the tray and carrier in assembled relationship.

Thus, by reason of the ribs 17 and 18 and protuberances 26*a, b* and *c* and the complementary slots 20, 21 and 23, 24 and 25, the tray member 11 must be disposed in a predetermined relative position with respect to the support 22 before the tray member can be properly accommodated by the carrier support 22. FIG. 6 shows the manner in which protuberances 26*a, b* and *c* interfit within slots 23, 24 and 25 respectively when tray 11 is positioned in its predetermined proper position in registration upon carrier 22. Similarly, a narrower lower capacity tray 11A may also be utilized upon carrier 22, and it, too, by suitable arrangement of slot and protuberance as will be explained more fully below may be caused to be uniquely positioned upon carrier 22 so that the rows of tray 11A are in registration with the position of the comparable rows of tray 11 which would otherwise be utilized. Thus, if the tray member 11 is lifted off the support 22, it will always of necessity be repositioned thereon the same way so that the row $A_1$ of receptacles will always be disposed adjacent the same end of the carrier. This is an important feature in assuring accuracy in preparing the samples in the receptacles for subsequent testing and analyzing.

Figure 5:
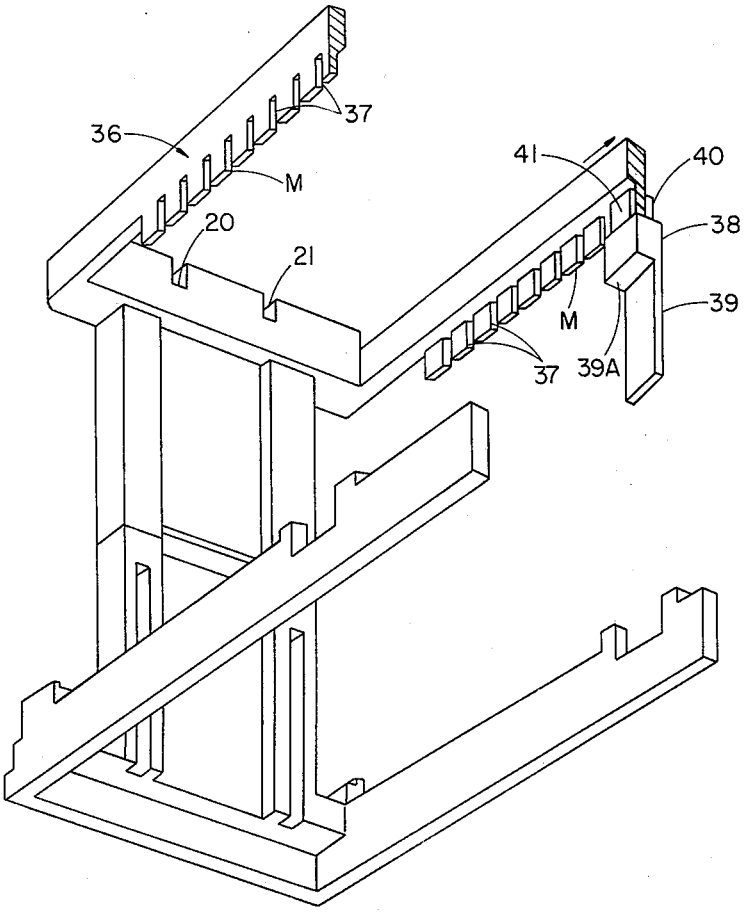
FIG. 5 is a fragmentary bottom perspective view of the carrier per se.

The carrier 16 in addition to support 22 also includes a base member 27 which is disposed in spaced, registered relation beneath the support 22, see FIGS. 4 and 5. The corresponding end of the support 22 and base member 27 are interconnected by a plurality of column elements 28 and 30.

Base member 27 delimits an enlarged opening 31 which provides access to the depending portions $R_1$ of the receptacles R carried by the tray member 11. The access opening 31 permits sensing devices and actuating means which produce vortical motion to the samples within the receptacles, to move upwardly into contact with various receptacles as may be seen in more detail in the aforementioned application Ser. No. 596,760. The assembly 10 in normal use is positioned within and automatically moved to various stations within an apparatus such as disclosed in the aforesaid co-pending application Ser. No. 567,349.

As seen in FIGS. 2 and 3, each opening formed in the top surface of the tray member 11 has positioned therein a retainer element 32 which is adapted to frictionally engage the upper open end portion $R_2$ of the receptacle accommodated within the opening of the tray member. The element 32 has an enlarged annular collar 33 formed at the upper end of a stem portion 34. The stem portion 34 is provided with a plurality of longitudinally extending grooves, not shown, which provide resiliency to the stem portion thereby facilitating initial insertion thereof through the opening. The lower end section of the stem portion is provided with an upwardly and outwardly tapered collet 35. The collet 35 is spaced from the collar 33 an amount substantially greater than the thickness of the tray member forming the top surface 13. In addition the outside diameter of the stem portion 34 intermediate the collar 33 and collet 35 is substantially less than the diameter of the tray member opening. Thus, each retainer element 32 fits loosely within the opening and thereby enables the depending portion $R_1$ of the receptacle to be displaced up to a predetermined angle from the vertical, enabling the receptacle to be actuated so as to impart vortical motion to the sample contained within the receptacle. FIG. 3 illustrates the extent to which the receptacle portion $R_1$ can be so displaced. It is customary for all of the receptacles in a transverse row to be simultaneously actuated.

FIGS. 4 and 5 show parallel corresponding side marginal portions of the support 22 to be provided with elongated depending skirts 36 which embody indexing means M, the latter comprising a plurality of longitudinally spaced slits 37. The slits are uniformly spaced and shaped, transversely cut across the lower edge of skirts 36, and are adapted to cooperate with complementary indexing means 38 (FIG. 5.) which is utilized within the apparatus of the type disclosed in the afore-noted co-pending application Ser. No. 567,349. Because the slits serve as indexors, it is important to note that a regular relationship exists between the uniform spacing of the slits, and the uniform distance between centers of the receptacle-accommodating openings.

Means 38 includes a support member 39 mounted to a stationary surface, for example upon the frame of the above-mentioned apparatus of application Ser. No. 567,349, and a light emitting diode 40 and a phototransistor 41. Support member 39 includes an extension portion 39A projecting transversely just under skirt 36. Extension 39A mounts light emitting diode 40 parallel and immediately adjacent the lower outside face of skirt 36. Extension 39A also mounts phototransistor 41 in a complementary fashion, parallel to and immediately adjacent the inside lower face of skirt 36. In this manner phototransistor 41, extension portion 39A, and light emitting diode 40 form a U-shaped channel through which the slitted portion of skirt 36 may be advanced (for example in the direction of the arrow in FIG. 5).

With the foregoing arrangement, the phototransistor 41 will see light from light emitting diode 40 only when one of slits 37 passes through indexing means 38. A pulse will appear at the output of phototransistor 41 whenever a slit passes through means 38. This output is received by conventional pulse counter means, and because of the aforenoted relationship between slit spacing and distance between receptacles, the counter then contains a running indication of the receptacle or tray position with respect to a given station. This indication may be accessed by the apparatus of the type disclosed in application Ser. No. 567,349 in the processing and tracking of unknown samples contained in the receptacles.

Figure 7:
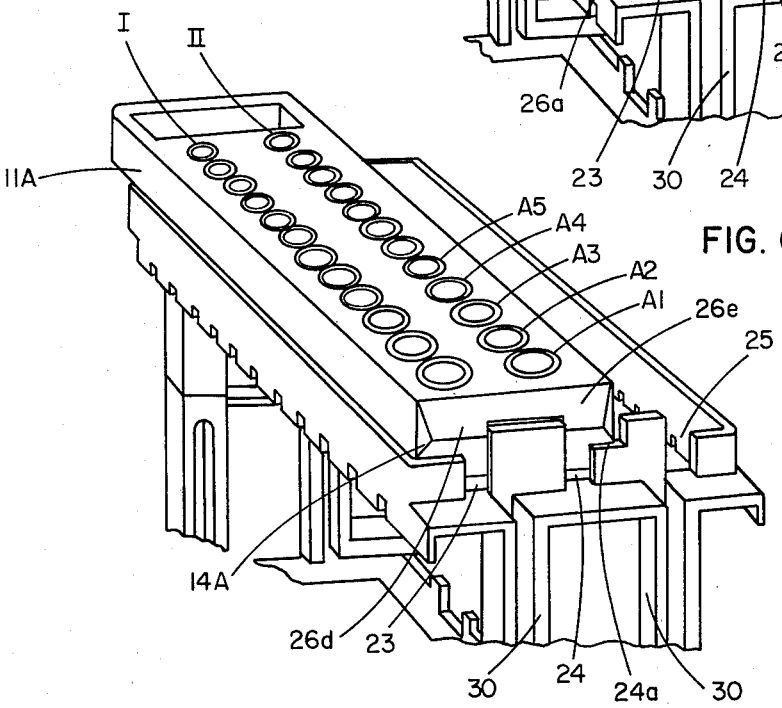
FIG. 7 is a view similar to FIG. 6, but showing the assembled relationship between a narrower variant tray and the same carrier.

It will be noted in FIG. 4 that slot 24 formed at the end of support 22 is provided with a step or notch 24*a* along one side thereof. The step 24*a* is adapted to accommodate a portion of the depending marginal flange of a narrower tray member 11A (see FIGS. 7 and 8) when the latter is accommodated by the support 22. In place of three rows of openings I, II and III formed in the tray member 11, narrower tray member 11A includes only two such rows. Furthermore, the number of openings comprising each longitudinal row may be varied from that shown, if desired. It will be noted that narrower tray 11A includes two protuberances 26*d* and 26*e* in end of marginal flange 14A, in a similar fashion to tray 11, with protuberance 26*d* corresponding in position to 26*a,* and 26*e* corresponding in position to 26*b,* however, at least one of these pairs which correspond in location do not correspond in configuration that is, protuberance 26*e* is different in configuration from protuberance 26*b,* since it includes a portion of the marginal flange of tray 11A. Accordingly the protuberance configuration varies in accordance with the number of longitudinal rows of the tray. The narrower tray, having fewer longitudinal rows, because of the unique mating relationship between step 24*a* of slot 24 within support 22, and protuberance 26*b* with its portion the marginal flange of that tray, can only be repositioned on the support 22 in one position, with the marginal portion included in protuberance 26*b* fitting within notch 24*a.* In this manner the first transverse row $A_1$ of receptacles will always be disposed adjacent the same end of the carrier and the first longitudinal row I of receptacle will always be disposed over the same longitudinal position on the carrier, regardless of whether tray 11 is used, or the narrower tray. In this way, the relative registration is made exactly compatible with trays having the larger number of longitudinal rows, and accuracy is insured to the same degree. The system is thus able to handle equally well a mix of trays with differing number of longitudinal rows, or a uniform loading of trays with consistent numbers of such rows.

The carrier 16, when not disposed within an apparatus of the type identified, will readily rest upon a supporting surface (e.g. countertop) and provide a stable upright rack for the tray member 11. To disengage the tray member from the carrier 16 requires only upwardly lifting of the tray member a sufficient amount to permit the lower extremities of the receptacles to clear the upper edge of the support.

The space formed between the support 22 and base member 27 is of a size so as to readily accommodate all of the freely depending receptacle portions $R_1$. The space is readily accessible from the bottom, top and sides.

Thus, it will be seen that a tray-carrier assembly has been provided which is of simple, inexpensive, sturdy and lightweight construction. The assembly is readily capable of simultaneously accommodating a variety of receptacles and further permits ready segregation of various receptacles, thereby enabling more accurate samples to be prepared.

Although the tray-carrier assembly has been found very advantageous for the twelve transverse two tray, and permits the rational intermixing of such trays, regardless of whether provided with one, or a plurality of longitudinal rows, it is not confined to such a format. As has been implied, the trays could equally well contain, for example, only four or eight longitudinal positions, instead of 12. Similarly, the trays could equally well include many more than three or four transverse positions, or as few as one such position. Finally, the format of the receptacle-accommodating positions need not necessarily be a rectangular one.

We claim:

1. In an assembly for accommodating a plurality of open end tubular receptacles, said assembly including a carrier and a tray member comprising one of a larger capacity tray and a smaller capacity tray, said trays provided with a plurality of openings formed therein within which said receptacles may be retained so as to freely depend from said tray, the improvement comprising a support defined upon said carrier and subtending and engaging marginal portions of said tray member whereby the latter is adapted to be removed from said support by being lifted therefrom, said support and tray member being provided with complementary interfitting means whereby said tray member is retained thereby in a unique predetermined position and orientation with respect to said support; and a base member included in said carrier and spaced beneath and in registered relation with said support and being interconnected thereto whereby a space is formed between said support and base member when said tray member is disposed in said predetermined position and orientation for accommodating the depending receptacle portions, said base member being provided with an access opening communicating with the space.

2. In the assembly of claim 1 wherein the tray member has an elongated configuration, the improvement in which said support has an elongated configuration, and the width of said support is at least as great as said tray member when said tray member is disposed in said predetermined position on said support.

3. The assembly of claim 2 wherein the support is provided with a pair of spaced, substantially parallel, elongated depending skirts, said skirts being disposed on opposite sides.

4. The assembly of claim 2, wherein said trays are provided with a plurality of openings formed thereon and arranged in a regular rectangular array, support is provided with an elongated depending skirt, and said elongated depending skirt has formed thereon means for associating a longitudinal position in said skirt with individual ones of said openings.

5. In the assembly of claim 3, wherein said trays are provided with a plurality of openings formed therein, and said openings formed are arranged in a regular rectangular array, the improvement wherein said elongated depending skirt is provided with a plurality of uniformly spaced slits cutting said skirt transversely, with the distance between slits bearing a regular relationship to the corresponding distances between centers of said receptacle accommodating openings.

6. In the assembly of claim 2, the improvement in which the complementary interfitting means comprises at least one longitudinal depending rib defined on said tray member and at least one vertically oriented slit defined at one end of said support, said slit being complementary to and adapted to receive said rib therein, said slit being spaced from one edge of said support by the same distance as the spacing of the rib from the complementary edge of said tray member, at least one upwardly opening slot within the other end of said support, and at least one protuberance complementary to said slot defined at one end of said tray said slot being spaced from said edge of said support by the same distance as the spacing of said protuberance from said complementary edge of said tray member whereby when said tray member may interfit upon said carrier in said unique predetermined position.

7. In the assembly of claim 6, wherein said tray also includes reinforcing portions depending from the lower surface of said tray and extending transversely from said ribs, the improvement wherein at least one of said transverse reinforcing portions overlaps the inside face of said one end of said support, at least one of said reinforcing portions being located at the end opposite said protuberance and spaced therefrom a distance equivalent to the spacing between opposite ends of said support, whereby said tray member is held more positively in a predetermined position upon said carrier when engaged thereupon.

8. In the assembly of claim 6, the improvement in which said trays are provided with a plurality of openings for receiving tubular receptacles, said opening being arranged thereon in a regular rectangular intermixed array of two longitudinally extending rows for said smaller capacity tray, and three longitudinally extending rows for said larger capacity trays, and in which for said smaller capacity tray, said protuberance is located at the corner of said end generally in alignment with said second row, and in which for said larger capacity tray, said protuberance is located intermediate said end and generally in alignment with said second row.

whereby regardless of tray capacity, first and second rows of openings are always located in the same position relative to said carrier.

* * * * *